US008816208B2

(12) United States Patent
Huang et al.

(10) Patent No.: US 8,816,208 B2
(45) Date of Patent: Aug. 26, 2014

(54) FLAT CABLE AND CABLE HARNESS USING THE SAME

(75) Inventors: Detian Huang, Hitachi (JP); Hiroshi Komuro, Hitachi (JP); Yuuki Yamamoto, Hitachi (JP); Kazushige Nagano, Hitachi (JP); Takanobu Watanabe, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 249 days.

(21) Appl. No.: 13/137,816

(22) Filed: Sep. 14, 2011

(65) Prior Publication Data

US 2012/0080226 A1 Apr. 5, 2012

(30) Foreign Application Priority Data

Sep. 30, 2010 (JP) ..... 2010-221646

(51) Int. Cl.
*H01B 7/08* (2006.01)
*H01B 11/20* (2006.01)

(52) U.S. Cl.
CPC ..... *H01B 11/203* (2013.01); *H01B 7/083* (2013.01)
USPC ..... 174/117 F

(58) Field of Classification Search
USPC ..... 174/117 F, 117 M, 120 R
See application file for complete search history.

(56) References Cited

U.S. PATENT DOCUMENTS

| | | | | |
|---|---|---|---|---|
| 4,818,820 | A * | 4/1989 | LaRock | 174/36 |
| 4,956,524 | A * | 9/1990 | Karkow | 174/117 M |
| 2006/0054334 | A1 * | 3/2006 | Vaupotic et al. | 174/36 |
| 2008/0176073 | A1 * | 7/2008 | Karayianni et al. | 428/375 |
| 2009/0242250 | A1 * | 10/2009 | Kohda et al. | 174/259 |
| 2010/0089610 | A1 | 4/2010 | Matsumoto | |

FOREIGN PATENT DOCUMENTS

| | | | |
|---|---|---|---|
| JP | 2001-101934 | A | 4/2001 |
| JP | 2005-327641 | * | 11/2005 |
| JP | 2008-235024 | A | 10/2008 |

* cited by examiner

*Primary Examiner* — Chau N Nguyen
(74) *Attorney, Agent, or Firm* — McGinn IP Law Group, PLLC

(57) ABSTRACT

A flat cable includes plurality of electric wires juxtaposed with each other and a fiber member woven along a juxtapositional direction of the electric wires to thread through a plurality of the electric wires. Each of the electric wires includes an outermost layer having a layer with an elongation of 20% or more and 100% or less and a tensile strength of 150 MPa or more. The fiber member is a fiber mainly made of polytrimethylene terephthalate.

18 Claims, 4 Drawing Sheets

FLAT CABLE AND CABLE HARNESS USING THE SAME

The present application is based on Japanese Patent Application No. 2010-221646 filed on Sep. 30, 2010, the entire contents of which are incorporated herein by reference.

BACKGROUND OF THE INVENTION

1. Field of the Invention

The present invention relates to a flat cable and a cable harness using the same, which is suitable to be installed in electronic devices such as camera, laptop computer, liquid crystal television.

2. Prior Art

In the electronic devices such as camera, laptop computer, liquid crystal television, as a cabling material (wiring material) for signal transmission which is installed in a connecting part or the like for connecting a main body for operating the electronic device and a display part such as liquid crystal display, a flexible printed circuit (FPC) has been often used, since the FPC is relatively flexible and can be disposed within a flat and thin type electronic device.

As the wiring material alternative to FPC, there is a flat cable formed by laying flatly a plurality of narrow wires (e.g. coaxial cables), and then weaving polyester fiber members to thread into each of the flatly laid wires along a direction substantially perpendicular to a longitudinal direction of the flatly laid wires. For example, JP-A 2001-101934 and JP-A 2008-235024 disclose such conventional flat cables.

For example, JP-A 2008-235024 discloses a flat cable (planar cable), in which a plurality of cables each of which includes an inner conductor and a protective coating layer for coating a periphery of the inner conductor are juxtaposed flatly to have a flat shape, and the juxtaposed cables contacting to each other are collected by weaving with a woof for each predetermined number. Further, warps are juxtaposed along sides of the juxtaposed cables in a width direction of the cables, and an elongation of the woof is greater than that of the warps.

According to the structure disclosed by JP-A 2008-235024, when the flat cable is deformed to be U-shape by bending the flat cable with angle of 180 degrees at a predetermined position, the woof in the bent portion extends and the cables of the bent portion may escape from clearances (gaps) between the woven cables and the woof in accordance with the extension of the woof at the bent portion. Therefore, it is possible to realize the inflection and deformation of the flat cable while keeping flat (planar) state of the flat cable, thereby maintaining the total configuration of the flat cable.

SUMMARY OF THE INVENTION

When installing the wiring material including the flat cable in the electronic device such as camera, the wiring material is often installed in a vacant wiring space between other members, such that the flat cable does not superimpose the other members disposed in the electronic device. On the other hand, as recent electronic devices are facing demands for making their main bodies even thinner, the wiring space (particularly, height) of the wiring material tends to be restricted.

FIG. 4 is an explanatory view of a flat cable 32 which meanders along a width direction of the flat cable 32 (juxtaposed direction of the electric wires) so as to avoid other members 30, 31. The flat cable which can meander to change the direction of wire installation is strongly demanded as the wiring material to be installed in a part with the limited wiring space.

Although the conventional flat cables as disclosed by JP-A 2001-101934 and JP-A 2008-235024 can be effectively used for the wire installation in which the flat cable is bent by the angle of 180 degrees at a predetermined position, it is difficult to install the conventional flat cable while bending a part thereof to meander through the obstacles or keeping the serpentine shape of the flat cable.

Accordingly, an object of the present invention is to provide a flat cable and a cable harness using the same, which can meander to be installed easily in a non-linear wiring space.

According to a first feature of the invention, a flat cable comprises:

a plurality of electric wires juxtaposed with each other, each of the electric wires comprising an outermost layer comprising a layer comprising an elongation of 20% or more and 100% or less and a tensile strength of 150 MPa or more; and a fiber member woven along a juxtapositional direction of the electric wires to thread through a plurality of the electric wires, the fiber member comprising a fiber comprising polytrimethylene terephthalate.

In the flat cable, the outermost layer may comprise a tape layer comprising a plastic tape.

In the flat cable, the tape layer may comprise a first tape layer formed by spirally winding the plastic tape, and a second tape layer formed by spirally winding the plastic tape around the first tape layer along a direction different from the winding direction of the first tape layer.

In the flat cable, the plastic tape may comprise a thin plastic tape formed by rolling, and an adhesive layer formed on an inner surface of the thin plastic tape. In the flat cable, a weaving density of the fiber member is preferably 20 or more and 30 or less for a length of 10 mm in the longitudinal direction of the electric wires.

In the flat cable, the fiber member may comprise a plurality of fiber threads that are lengthwise disposed, and each of the fiber threads comprises a plurality of monofilaments.

According to another feature of the invention, a cable harness comprises:

a flat cable comprising a plurality of electric wires juxtaposed with each other, each of the electric wires comprising an outermost layer comprising a layer comprising an elongation of 20% or more and 100% or less and a tensile strength of 150 MPa or more, and a fiber member woven along a juxtapositional direction of the electric wires to thread through a plurality of the electric wires, the fiber member comprising a fiber comprising polytrimethylene terephthalate; and a connecting terminal connected to an end portion of the flat cable.

Points of the Invention

The present invention provides a flat cable comprising a plurality of electric wires juxtaposed with each other, and a fiber member which is woven along a juxtapositional direction of the electric wires to thread through a plurality of the electric wires, in which each of the electric wires comprises a jacket as an outermost layer comprising a layer with an elongation of 20% or more and 100% or less and a tensile strength of 150 MPa or more, and the fiber member comprises a fiber comprising polytrimethylene terephthalate. According to this structure, it is possible to provide a flat cable and a cable harness using the same, which can meander in a non-linear wiring space to be installed easily.

BRIEF DESCRIPTION OF DRAWINGS

Next, embodiment according to the invention will be explained in conjunction with appended drawings, wherein.

DETAILED DESCRIPTION OF THE PREFERRED EMBODIMENT

Next, the embodiment according to the present invention will be explained in more detail in conjunction with the appended drawings.

Figure 1:
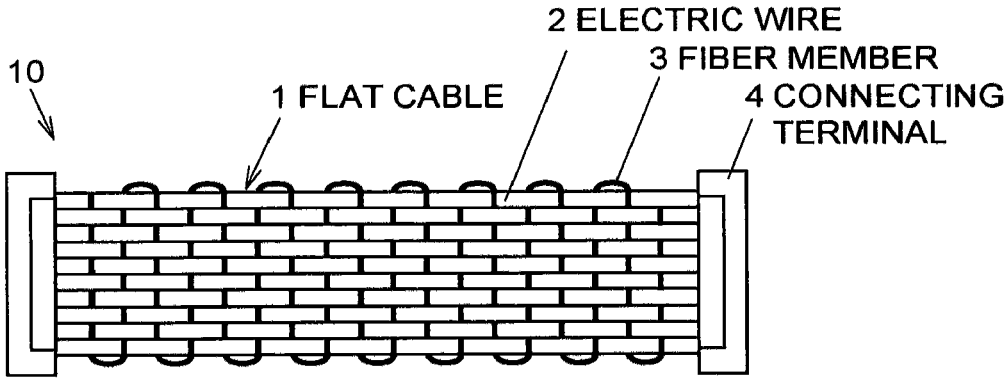
FIG. 1 is a plan view of a cable harness using a flat cable in an embodiment according to the present invention.

FIG. 1 is a plan view of a cable harness 10 using a flat cable 1 in the embodiment according to the present invention.

(Total Structure of a Cable Harness 10)

Referring to FIG. 1, the cable harness 10 comprises a flat cable 1 and connecting terminals (connectors) 4 connected to both end portions of the flat cable 1.

(Total Structure of a Flat Cable 1)

Referring to FIG. 1, the flat cable 1 comprises a plurality of electric wires 2 arranged in geometrically parallel (i.e. juxtaposed), and a fiber member 3 which is woven along a juxtapositional direction of the electric wires 2 (i.e. a direction substantially perpendicular to a longitudinal direction of the electric wires 2) to thread through a plurality of the electric wires 2.

(Fabrication Method of the Flat Cable 1)

The flat cable 1 is fabricated by a fabrication method comprising a step of arranging a plurality of the electric wires 2 in geometrically parallel (i.e. juxtaposing the electric wires 2), a step of weaving a fiber member 3 along a juxtapositional direction of the electric wires 2 to thread through a plurality of the electric wires 2, and a step of heating the fiber member 3.

(Heat Treatment of the Fiber Member 3)

The step of heating the fiber member 3 is conducted, for example, at a temperature of 100° C. or more and 120° C. or less. At this point, heat treatment of the fiber member 3 is preferably conducted at the temperature of 100° C. or more and 120° C. or less while a surface of the fiber member 3 contains moisture.

As to a method of heat treatment for obtaining the flat cable 1, following methods may be used. For example, the fiber member 3 may be heated by treating a flat cable main body comprising the fiber member 3 woven into the electric wires 2 to make the surface of the fiber member 3 contain moisture, and moving a heating roller which is heated at the temperature of 100° C. or more and 120° C. or less along the longitudinal direction of the flat cable main body to be placed along the surface of the fiber member 3. Alternatively, the fiber member 3 may be heated by placing the flat cable main body in a heating apparatus such as thermostatic chamber and heating the fiber member 3 at the temperature of 100° C. or more and 120° C. while spraying vapor (steam) etc. on the surface of the fiber member 3, to make the surface of the fiber member 3 contain moisture. In such heat treatment method, the fiber member 3 may be heated while the surface of the fiber member 3 contains moisture by using the heating roller having a function of spraying vapor. According to this heat treatment, the fiber member 3 is contracted so that each of the electric wires 2 is kept being neatly arranged. Through such heat treatment, a width of the flat cable main body is contracted in a range e.g. from about 15 mm to about 11 mm so that the flat cable 1 is provided.

(Structure of the Electric Wire 2)

Figure 2:
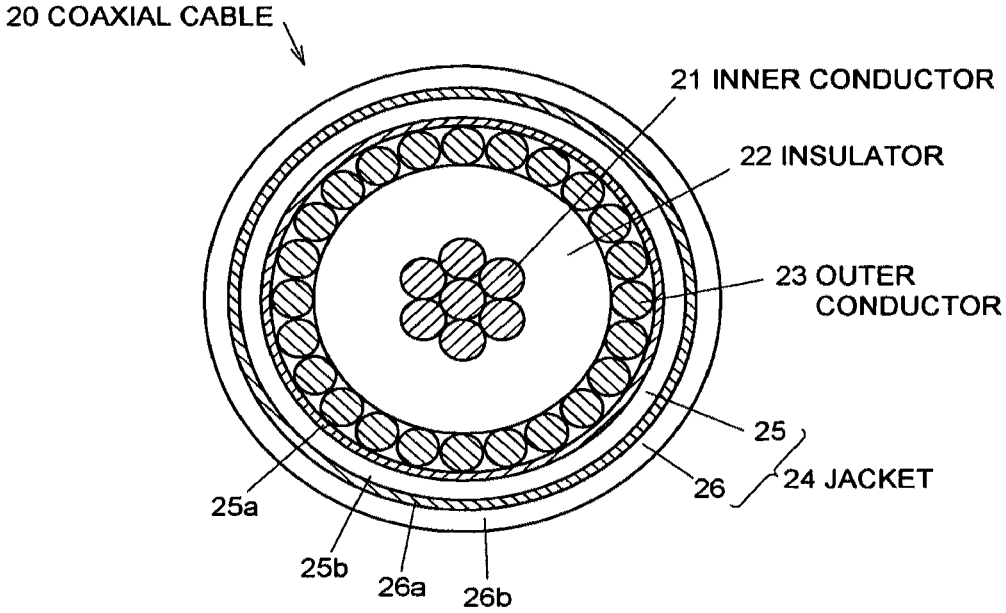
FIG. 2 is a cross sectional view of an electric wire used in a flat cable in the embodiment according to the present invention.

FIG. 2 is a cross sectional view of the electric wire 2 used in the flat cable 1 in the embodiment according to the present invention.

Referring to FIG. 2, each of the electric wires 2 comprises a coaxial cable 20 comprising, for example, an inner conductor 21 formed of a plurality of copper wires stranded together, an insulator 22 formed around an outer periphery of the inner conductor 21, an outer conductor 23 formed by spirally wrapping a plurality of conductors around an outer periphery of the insulator 22, and a jacket 24 formed around an outer periphery of the outer conductor 23.

The insulator 22 comprises fluororesin such as tetrafluoroethylene perfluoroalkyl vinyl ether copolymer (PFA), tetrafluoroethylene hexafluoropropylene copolymer (FEP), and ethylene tetrafluoroethylene copolymer (EIFE), or polyethylene terephthalate (PET).

The outer conductor 23 is formed by using a conductor (a single wire or a stranded wire) comprising a metal wire (including a surface plated wire) such as a soft copper wire.

The jacket 24 as an outermost layer comprises a layer with an elongation (i.e. elongation percentage) of 20% or more and 100% or less and a tensile strength of 150 MPa or more.

If the elongation of the jacket 24 is less than 20%, the flexibility of the flat cable 1 using the jacket 24 will be greatly deteriorated, so that it becomes difficult to displace a part of the flat cable 1 in parallel (i.e. translate a part of the flat cable 1) along the width direction to meander. On the other hand, if the elongation of the jacket 24 is greater than 100%, in the case of displacing the part of the flat cable 1 in parallel to meander, it is impossible to effectively provide a deformed portion of the flat cable 1 with a repulsive force toward a direction opposite to the direction of parallel displacement. As a material satisfying the aforementioned properties, for example, PET may be used.

Figure 5:
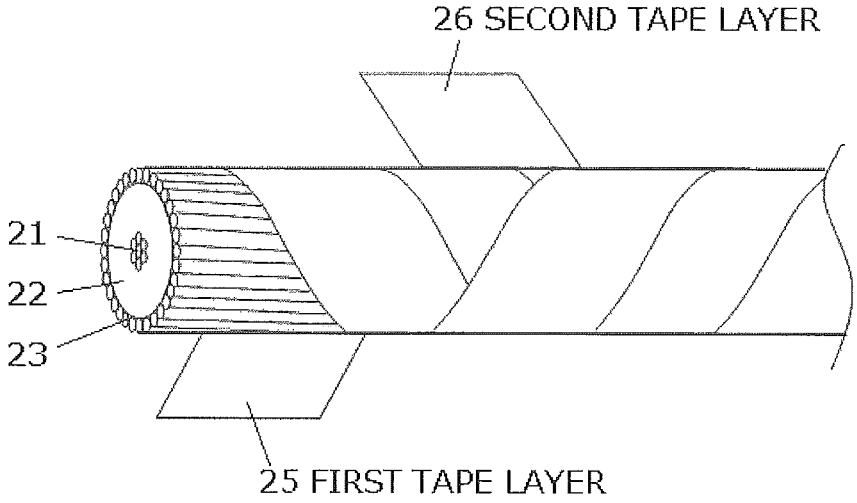
FIG. 5 is a side view of an electric wire used in a flat cable in the embodiment according to the present invention.

The jacket 24 as the outermost layer comprises a tape layer formed by using a plastic tape. As shown in FIG. 5, the tape layer comprises a first tape layer 25 formed by spirally winding (e.g. wrapping) a plastic tape, and a second tape layer 26 formed by spirally winding (e.g. wrapping) a plastic tape around the first tape layer 25 along a direction different from the winding direction of the first tape layer 25. In the present invention, the jacket 24 as the outermost layer is not limited to the tape layer. The outermost layer may be a layer formed by extrusion-coating a resin such as PET, as long as the outermost layer has the elongation of 20% or more and 100% or less and the tensile strength of 150 MPa or more.

In the case that the outermost layer comprises the tape layer, the plastic tape preferably comprises a thin plastic tape which is formed by rolling and has the elongation of 30% or more and 140% or less. For example, the thin plastic tape may have a width of 2 to 3 mm and a thickness of 5 μm or less. If the thin plastic tape has the elongation less than 30% or greater than 140%, it is possible that the jacket 24 as the outermost layer of the electric wire 2 which is formed from such a thin plastic tape cannot satisfy the elongation of 20% or more and 100% or less and the tensile strength of 150 MPa or more, due to the heat at the heat treatment process of the fiber member 3.

Further, in the case that the outermost layer comprises the tape layer, it is possible to change the elongation and the tensile strength of the outermost layer by appropriately adjusting the thickness of a tape to be used as the tape layer, a winding pitch of the tape, and the like.

Further, the first tape layer 25 is preferably made from a shield tape comprising a metal layer 25*a* which is vapor-deposited (e.g. a deposited Cu layer with a thickness of 0.1 to 0.3 μm) on an inner surface (on a side contacting to the outer conductor 23) of a thin plastic tape 25*b*. The second tape layer 26 is preferably made from an adhesive tape comprising an adhesive layer 26*a* which is formed on an inner surface (on a side contacting to the first tape layer 25) of a thin plastic tape 26*b*.

In the case that the tape layer is composed of a single layer, the shield tape or the adhesive tape may be used alone. Alternatively, the shield tape may have an adhesive layer as an innermost layer. Further, both of the first tape layer 25 and the second tape layer 26 may be the adhesive tapes.

In the field of the electric wire for electronic devices such as coaxial cable, the jacket as the outermost layer is in general made from a soft layer (namely, a layer having a high elongation and small tensile strength) so as to provide the coaxial cable with excellent flexibility. The soft layer is provided by extrusion molding, namely extrusion-coating fluorine resin around a periphery of the outer conductor or winding a plastic tape made from PET or the like, so as to suppress the deterioration in transmission characteristic due to the bending of the coaxial cable.

In the conventional jacket as the outermost layer, although it is possible to provide the electric wire with the excellent flexibility, it is difficult to install the flat cable using the electric wire having such a jacket, while making the flat cable meander or keeping the serpentine shape of the flat cable.

Therefore, the Inventors remarked the hardness of the jacket 24 as the outermost layer of the electric wire 2. After zealous studies, the Inventors found that the outermost layer of the electric wire 2 preferably comprises a layer with the hardness greater than the conventional one, namely, the elongation of 20% or more and 100% or less and the tensile strength of 150 MPa or more. According to this structure, in the case of deforming the flat cable using such an electric wire to displace a part of the flat cable in parallel along the width direction, it is possible to effectively provide the deformed portion of the flat cable with a repulsive force toward a direction opposite to the direction of parallel displacement, without preventing the flat cable from the parallel displacement. Based on these findings, the Inventors provided a flat cable and a cable harness using the same, which can meander to be installed in a non-linear wiring space and can be installed while keeping the serpentine shape.

An outer diameter of each of the electric wires 2 is preferably 0.35 mm or less, considering that they are put through a connecting part of camera, laptop computer or liquid crystal television, or the like.

(Weaving of the Fiber Member 3)

The fiber member 3 is woven to thread through each of the electric wires 2 from one end of the flat cable 1 in the longitudinal direction to another end (from left side to right side in FIG. 1), shuttling back and forth in zigzag, while flatly securing a plurality of the electric wires 2 in the longitudinal direction.

At this time, the fiber member 3 is preferably woven in the center portion in the width direction of the flat cable 1 (the juxtapositional direction of the electric wires 2) to thread through units each of which is made of at least two of the electric wires 2, and at the ends in the width direction of the flat cable 1 to thread through units each of which is made of one of the electric wires 2. The center portion in the width direction of the flat cable 1 is not limited to a center axis of the flat cable 1, and may include portions in the vicinity of the center axis. Also, the ends in the width direction of the flat cable 1 are not limited to outermost positions in the width direction of the flat cable 1, and may include portions in the vicinity of the outermost positions.

According to such a configuration, the number of times that the fiber member 3 is woven can be reduced and the width of the flat cable 1 can be decreased simultaneously, compared with the case when the fiber member 3 is woven to thread through the units each of which is made of one of the electric wires 2.

Although the fiber member 3 is woven over an entire length of the flat cable 1, the fiber member 3 at the both ends in the longitudinal direction of the flat cable 1 is removed for the ease of attaching connecting terminals 4 configured to be connected to the electronic device.

A weaving density of the fiber member 3 is preferably constant over the entire length of the flat cable 1, or coarser at the end parts than in the center portion in the longitudinal direction of the flat cable 1. By making the weaving density of the fiber member 3 coarser at the end parts than in the center portion in the longitudinal direction of the flat cable 1, a shape of the flat cable 1 is held flat, and operation for removing the fiber member 3 can be made easier when the connecting terminals 4 are attached.

The weaving density of the fiber member 3 is expressed by a relational expression "(d×N)/L", where d is an outer diameter of each fiber member 3, N is the number of the fiber members 3 woven within a range of a predetermined length L (mm) in a longitudinal direction of a flat cable 1 (including the electric wires 2). The weaving density of the fiber member 3 is preferably 20 or more and 30 or less for a length of 10 mm in the longitudinal direction of the electric wires 2. According to this configuration, the electric wires 2 will not be exposed from the clearances of a mesh of the woven fiber member 3 or will not shift from the clearances so much when the flat cable 1 is bent or meanders. Therefore, when a part of the flat cable 1 is deformed to be displaced in parallel along the width direction, the repulsive force generated in the deformed portion of the flat cable 1 can be obtained effectively.

The fiber member 3 preferably comprises a wooly filament (bulked continuous filament) formed by stranding a plurality of fiber threads, each of which is formed by bundling a plurality of fibers, or lengthwise disposing the plurality of fiber threads. For example, it is preferable to form the fiber member 3 by lengthwise disposing two fiber threads with 70 to 80 deniers, each of which comprises 30 to 40 monofilaments. By lengthwise disposing a plurality of the fiber threads in the fiber member 3, it is possible to relax the stress applied to the electric wires 2 without tightening the electric wires 2 excessively.

As a fiber for the fiber member 3, it is preferable to use fibers such as polytrimethylene terephthalate (PTT) made from a condensation polymer of 1,3-propanediol and terephthalic acid (e.g. Solotex (registered trademark) by Solotex Corporation, T400 by Toray Opelontex Co., Ltd. etc.).

The fiber member is usually interwoven in the condition that the fiber member is maximally expanded, so that the flexibility of the flat cable after weaving the fiber member is decreased. In addition, there is a possibility that the electric wires may be broken when it was bent strongly to tighten the electric wire.

On the contrary, by using the fiber member 3 comprising PTT the fiber member 3 will further elongate for around 10% to 50% because of the heat treatment, even after the fiber member 3 is interwoven. Accordingly, the flexibility of flat cable 1 will not be deteriorated and the electric wire 2 will not be strongly tightened. Therefore, when the flat cable 1 slides toward the juxtapositional direction, the fiber member 3 will elongate to follow the displacement of the electric wires 2 in the juxtapositional direction, so that the position of the fiber member 3 will be shifted.

Further, by using the fiber member 3 formed by lengthwise disposing the plurality of fiber threads, each of which is formed by bundling a plurality of PIT fibers, it is possible to relax the stress applied to the electric wires 2 when the flat cable 1 is bent or slid, compared with the case where the fiber member composed of a single fiber thread is used. Consequently, resistance to operations such as bending and meandering can be improved.

According to this structure, when the flat cable 1 is installed in the wiring space while keeping the serpentine shape, it is possible to effectively generate a desired repulsive force at the deformed portion of the flat cable 1. Therefore, it is possible to impart a force of suppressing the movement of the fiber member 3 toward the meandering direction appropriately.

In other words, it is possible to balance a moving force of the fiber member 3 toward the meandering direction and a suppressing force against the movement of the fiber member 3 toward the meandering direction, when the flat cable 1 is deformed to have the serpentine shape. Accordingly, according to the structure of the flat cable 1, even in the case of installing the flat cable 1 in the non-linear wiring space, it is possible to change the wiring direction of the wiring member, while keeping the serpentine shape without bending a part of the wiring member in the longitudinal direction, by making the flat cable 1 meander through the other members.

In conclusion, the present invention provides a flat cable comprising a plurality of electric wires juxtaposed with each other, and a fiber member which is woven along a juxtapositional direction of the electric wires to thread through a plurality of the electric wires, in which each of the electric wires comprises an outermost layer comprising a layer with an elongation of 20% or more and 100% or less and a tensile strength of 150 MPa or more, and the fiber member comprises fibers comprising polytrimethylene terephthalate. According to this structure, it is possible to provide a flat cable which can meander in the non-linear wiring space to be installed easily.

In addition, by connecting the connecting terminals 4 to the end portions of the flat cable 1, it is possible to provide a cable harness 10 as shown in FIG. 1, which can meander without bending and can be easily installed in the non-linear wiring space.

EXAMPLES

Next, Examples of the present invention will be explained below.

Examples 1 to 4 and Comparative Examples 1 to 3

As a sample of an electric wire, a coaxial cable (an outer diameter of 0.305 mm) having a following configuration was used. Namely, the coaxial cable includes an inner conductor formed of seven copper-alloy wires stranded together, each of which has an outer diameter of 0.025 mm, an insulator formed by extrusion-coating of PFA around an outer periphery of the inner conductor, an outer conductor formed by spirally wrapping a plurality of Sn-plated copper alloy wires around an outer periphery of the insulator, and an outermost layer (jacket) formed around an outer periphery of the outer conductor. Further, the outermost layer (jacket) comprises a first tape layer formed by spirally winding an adhesive tape comprising an adhesive layer provided on an inner surface of a thin plastic tape (made of PET with a thickness of 0.004 mm and a width of 2 mm) such that the adhesive layer adheres to the outer conductor, and a second tape layer formed by spirally winding an adhesive tape comprising an adhesive layer provided on an inner surface of a thin plastic tape (made of PET with a thickness of 0.004 mm and a width of 2 mm) such that the adhesive layer adheres to the first tape layer.

Further, the sample of the flat cable for each example having a thickness of 0.4 mm and a width of 10.5 mm was fabricated by juxtaposing forty (40) coaxial cables prepared as above, weaving a fiber member having a structure and properties as shown in TABLE 1 to thread through the forty coaxial cables to have a flat shape, and heat-treating the fiber member in the state that a surface of the fiber member contains moisture at temperature of 120° C.

Reference Example of the Prior Art

Sample of a conventional flat cable was prepared as a reference example, similarly to the method for preparing the samples in Examples 1 to 4 and comparative examples 1 to 3, except that a coaxial cable comprises an outermost layer formed by extrusion-coating of PFA.

In the Examples, the sliding property of the flat cable along the juxtapositional direction was evaluated as follows.

Figure 3:
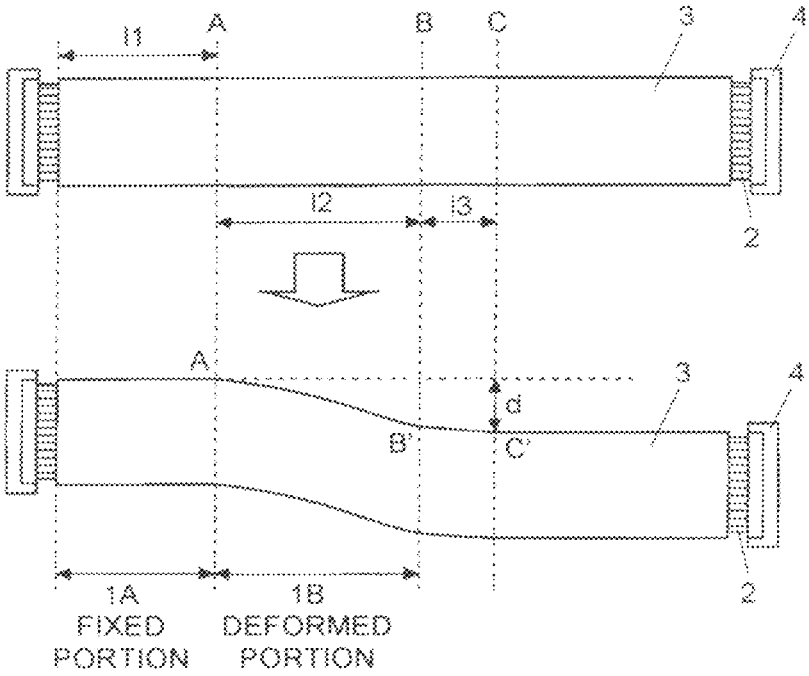
FIG. 3 is an explanatory diagram for explaining the method of evaluating the sliding property along the juxtapositional direction of the flat cable in the embodiment.
Figure 4:
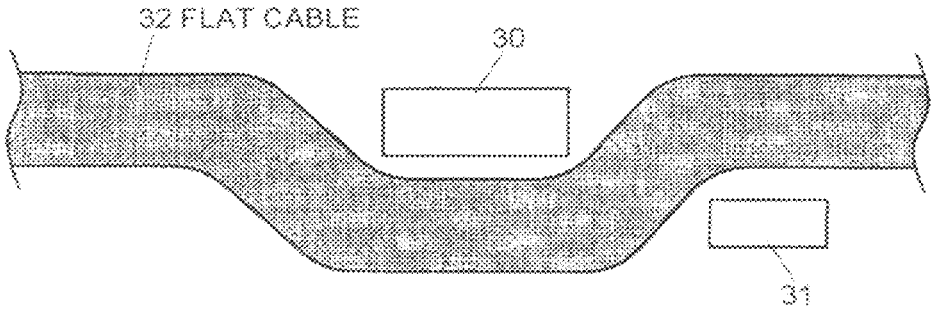
FIG. 4 is an explanatory diagram showing the method for installing the flat cable.

FIG. 3 is an explanatory diagram for explaining the evaluation method of the sliding property along the juxtapositional direction of the flat cable in the embodiment. In FIG. 3, a length l1 of a fixed portion 1A was 15 mm, namely, the length l1 is a distance from a fixed end of the flat cable to a point A which is an interface between a fixed portion 1A and one end of a deformed portion 1B. A length l2 of the deformed portion 1B before deformation was 20 mm, namely, the length l2 is a distance from the point A to a point B which is located at another end of the deformed portion. A length l3 between the point B and a point C which is a predetermined point for evaluating the sliding property is 10 mm. Accordingly, a distance from the point A to the point C is 30 mm. A parallel displacement distance d is a distance from the point C to a point C'.

Firstly, connecting terminals (connectors) 4 were attached to both end portions in the longitudinal direction of the sample of the flat cable including the electric wires 2 and the fiber member 3 to provide a sample of a cable harness.

Next, referring to un upper part of FIG. 3, as to one end of each sample of the flat cable, a portion covered by the fiber member 3 was fixed to a flat surface as the fixed portion 1A. The fixed portion 1A extends from the one end of the covered portion to the point A which is distant from the one end for about 15 mm along the longitudinal direction of the flat cable.

Thereafter, referring to a lower part of FIG. 3, a portion of the flat cable at the point B which is distant from another end (the point A) of the fixed portion 1A for about 20 mm along the longitudinal direction of the flat cable was held up. Then, the portion at the point B was displaced in parallel (i.e. slid) along the juxtapositional direction (i.e. the width direction) to be deformed, as indicated by an arrow.

Thereafter, when the parallel displacement distance d between the point C and the point C' which is distant from the point A for 30 mm reaches 5 mm, the state of the deformed portion 1B (a portion extending from the point A to the point B' in the lower part of FIG. 3) of the flat cable was visually observed.

The sample, in which the deformed portion 1B was not floating on a flat surface to which the flat cable was fixed, no undulation occurs in the electric wires 2, and no buckling occurs in the outermost layer, was evaluated as "○" (acceptable). The sample, in which the deformed portion 1B was floating on the flat surface, any undulation occurs in the electric wires 2, or any buckling occurs in the outermost layer, was evaluated as "x" (unacceptable).

The elongation and tensile strength of the outermost layer were evaluated according to JIS C2151 "Testing methods of plastic films for electrical purposes".

TABLE 1 shows the evaluation results.

TABLE 1

| Items | Ex. 1 | Ex. 2 | Ex. 3 | Ex. 4 | Comp. Ex. 1 | Comp. Ex. 2 | Comp. Ex. 3 | Prior art |
|---|---|---|---|---|---|---|---|---|
| Inner conductor size | AWG42 | | | | | | | |
| Inner conductor structure | 7/0.025 mm | | | | | | | |
| Insulator material | PFA | | | | | | | |
| Insulator outer diameter | 0.205 mm | | | | | | | |
| Outer conductor wire diameter | 0.030 mm | | | | | | | |
| Outer conductor outer diameter | 0.265 mm | | | | | | | |
| Outermost layer material | PET | | | | | | | PFA |
| Outermost layer outer diameter | 0.305 mm | | | | | | | |
| Outermost layer elongation | 20% | 80% | 100% | 100% | 15% | 110% | 80% | 150% |
| Outermost layer tensile strength | 180 Mpa | | | 150 Mpa | | 180 Mpa | | 35 MPa |
| Electric wire Number and arrangement | 40/juxtaposition (parallel arrangement) | | | | | | | |
| Fiber member structure | (75 deniers/36 monofilaments) × 2 | | | | | | | |
| Fiber member material | PTT | | | | | | PET | |
| Flat cable width | 10.5 mm | | | | | | | |
| Translational sliding property | ○ | ○ | ○ | ○ | X (Buckling) | X (Floating and undulation) | X (Floating and undulation) | X (Floating and undulation) |

("Ex." = Example, "Comp. Ex." = Comparative Example)

Based on the results shown in TABLE 1, it is confirmed that the buckling occurred when the electric wires 2 were slid in the comparative example 1, in which the elongation of the outermost layer was less than 20% (i.e. 15%). It is also confirmed that the floating and the undulation occurred when the electric wires 2 were slid in the comparative example 2, in which the elongation of the outermost layer was greater than 100% (i.e. 110%). It is further confirmed that the floating and the undulation occurred when the electric wires 2 were slid in the prior art, in which the material of the outermost layer was PFA (tensile strength of 35 MPa), i.e. the tensile strength of the outermost layer was less than 150 MPa.

On the contrary, none of buckling, floating and undulation occurred in Examples 1 to 4, in which the elongation of the outermost layer was 20% or more and 100% or less, a tensile strength thereof was 150 MPa or more, and the fiber member comprised PTT.

From the evaluation result as shown above, it is proved that it is possible to provide the flat cable and the cable harness using the same which can meander without bending to be easily installed in the non-linear wiring space according to the present invention.

Although the invention has been described with respect to the specific embodiments for complete and clear disclosure, the appended claims are not to be therefore limited but are to be construed as embodying all modifications and alternative constructions that may occur to one skilled in the art which fairly fall within the basic teaching herein set forth.

What is claimed is:

1. A flat cable, comprising:

a plurality of electric wires juxtaposed with each other, each of the electric wires comprising an outermost layer comprising a layer with an elongation of 20% or more and 100% or less and a tensile strength of 150 MPa or more; and a fiber member woven along a juxtapositional direction of the electric wires to thread through a plurality of the electric wires, the fiber member comprising a fiber comprising polytrimethylene terephthalate, wherein the fiber member is woven along a direction substantially perpendicular to a longitudinal direction of the electric wires, and wherein the fiber member is contracted by a heat treatment carried out on the fiber member comprising a surface containing moisture.

2. The flat cable according to claim 1, wherein the outermost layer comprises a tape layer comprising a plastic tape.

3. The flat cable according to claim 2, wherein the tape layer comprises a first tape layer formed by spirally winding the plastic tape, and a second tape layer formed by spirally winding the plastic tape around the first tape layer along a direction different from a winding direction of the first tape layer.

4. The flat cable according to claim 2, wherein the plastic tape comprises a thin plastic tape formed by rolling, and an adhesive layer formed on an inner surface of the thin plastic tape.

5. The flat cable according to claim 1, wherein a weaving density of the fiber member is 20 or more and 30 or less for a length of 10 mm in the longitudinal direction of the electric wires.

6. The flat cable according to claim 1, wherein the fiber member comprises a plurality of fiber threads that are lengthwise disposed, and each of the fiber threads comprises a plurality of monofilaments.

7. The flat cable according to claim 1, wherein the layer of the outermost layer comprises polyethylene terephthalate (PET).

8. The flat cable according to claim 1, wherein the fiber member is contracted to align the electric wires.

9. The flat cable according to claim 1, wherein the elongation of the layer of the outermost layer is in a range from 80% to 100%.

10. The flat cable according to claim 1, wherein the fiber member is woven along the direction substantially perpendicular to the longitudinal direction of the electric wires such that the fiber member extends perpendicular to a longitudinal direction of each of the electric wires.

11. A cable harness, comprising:

a flat cable comprising a plurality of electric wires juxtaposed with each other, each of the electric wires comprising an outermost layer comprising a layer with an elongation of 20% or more and 100% or less and a tensile strength of 150 MPa or more, and a fiber member woven along a juxtapositional direction of the electric wires to thread through a plurality of the electric wires, the fiber member comprising a fiber comprising polytrimethylene terephthalate; and a connecting terminal connected to an end portion of the flat cable, wherein the fiber member is woven along a direction substantially perpendicular to a longitudinal direction of the electric wires, and wherein the fiber member is contracted by a heat treatment carried out on the fiber member comprising a surface containing moisture.

12. The cable harness according to claim 11, wherein the outermost layer comprises a tape layer comprising a plastic tape.

13. The cable harness according to claim 12, wherein the tape layer comprises a first tape layer formed by spirally winding the plastic tape, and a second tape layer formed by spirally winding the plastic tape around the first tape layer along a direction different from a winding direction of the first tape layer.

14. The cable harness according to claim 12, wherein the plastic tape comprises a thin plastic tape formed by rolling, and an adhesive layer formed on an inner surface of the thin plastic tape.

15. The cable harness according to claim 11, wherein a weaving density of the fiber member is 20 or more and 30 or less for a length of 10 mm longitudinal direction of the electric wires.

16. The cable harness according to claim 11, wherein the fiber member comprises a plurality of fiber threads that are lengthwise disposed, and each of the fiber threads comprises a plurality of monofilaments.

17. The cable harness according to claim 11, wherein the fiber member has a lower elongation compared to the elongation of the outermost layer.

18. A flat cable, comprising:

a plurality of electric wires juxtaposed with each other, each of the electric wires comprising an outermost layer comprising a layer with an elongation of 20% or more and 100% or less and a tensile strength of 150 MPa or more; and a fiber member woven along a juxtapositional direction of the electric wires to thread through a plurality of the electric wires, the fiber member comprising a fiber comprising polytrimethylene terephthalate, wherein the fiber member is woven along a direction substantially perpendicular to a longitudinal direction of the electric wires, and wherein the fiber member after a heat treatment has an elongation of 10% to 50%.

* * * * *